US007004826B2

(12) United States Patent
Linnenbrink

(10) Patent No.: US 7,004,826 B2
(45) Date of Patent: Feb. 28, 2006

(54) DEVICE FOR SMOOTHING GEAR WHEELS

(76) Inventor: Wolfgang Linnenbrink, Pollbrede 8, Warburg-Rimbeck (DE) 34414

( * ) Notice: Subject to any disclaimer, the term of this patent is extended or adjusted under 35 U.S.C. 154(b) by 0 days.

(21) Appl. No.: 10/846,213

(22) Filed: May 10, 2004

(65) Prior Publication Data

US 2005/0181714 A1 Aug. 18, 2005

(30) Foreign Application Priority Data

Feb. 12, 2004 (EP) ..... 04003106

(51) Int. Cl.
*B24B 1/00* (2006.01)

(52) U.S. Cl. ..... 451/194; 451/253; 451/199

(58) Field of Classification Search ..... 451/194, 451/199, 209, 210, 211, 219; 29/90.6
See application file for complete search history.

(56) References Cited

U.S. PATENT DOCUMENTS

| | | | | | |
|---|---|---|---|---|---|
| 1,024,435 | A | * | 4/1912 | Bissell | 451/65 |
| 1,576,806 | A | * | 3/1926 | Blood | 29/90.6 |
| 1,599,818 | A | * | 9/1926 | Hoke | 451/140 |
| 1,658,899 | A | * | 2/1928 | Hoke | 451/47 |
| 1,707,555 | A | * | 4/1929 | Jones | 451/114 |
| 1,712,095 | A | * | 5/1929 | Schurr | 72/102 |
| 1,912,216 | A | * | 5/1933 | Alfred | 451/47 |
| 1,990,239 | A | * | 2/1935 | Miller | 29/90.6 |
| 2,060,803 | A | * | 11/1936 | Falk | 73/162 |
| 2,105,896 | A | * | 1/1938 | Stubbs | 451/540 |
| 2,139,290 | A | * | 12/1938 | Slomer | 451/47 |
| 2,352,557 | A | | 6/1944 | Miller | |
| 2,389,549 | A | * | 11/1945 | Ross | 451/163 |
| 3,139,707 | A | * | 7/1964 | Andrews | 451/163 |
| 3,391,495 | A | * | 7/1968 | Maurer | 451/47 |
| 4,067,218 | A | * | 1/1978 | Bibbens | 72/107 |
| 4,414,780 | A | * | 11/1983 | Jorgensen | 451/114 |
| 4,583,271 | A | * | 4/1986 | Diener | 29/90.6 |
| 4,972,564 | A | * | 11/1990 | Kawasaki et al. | 29/90.6 |
| 6,561,869 | B1 | * | 5/2003 | Asano et al. | 451/8 |

FOREIGN PATENT DOCUMENTS

| | | |
|---|---|---|
| DE | 914 365 | 5/1954 |
| DE | 32 30 860 C2 | 3/1983 |
| EP | 0 366 074 A2 | 5/1990 |

* cited by examiner

*Primary Examiner*—M. Rachuba
(74) *Attorney, Agent, or Firm*—Laurence A. Greenberg; Werner H. Stemer; Ralph E. Locher

(57) ABSTRACT

An apparatus for smoothing gear wheels has a single smoothing wheel and two further smoothing wheels opposite the single smoothing wheel. A clamping device for axially clamping the gearwheel to be smoothed can oscillate in a direction perpendicular to its rotation. The smoothing wheels are mounted on bearing brackets, which may be tensioned against one another in such a way that the gearwheel to be smoothed positioned between them is centered and may have a predetermined force applied to it. The bearing brackets form a separate clamping unit that is movable in parallel in such a way that the axis of rotation of the gearwheel to be smoothed runs coaxially to the central axis of its clamping device, which may oscillate.

7 Claims, 2 Drawing Sheets

DEVICE FOR SMOOTHING GEAR WHEELS

BACKGROUND OF THE INVENTION

Field of the Invention

The present invention relates to a device for smoothing gear wheels. The device has a single smoothing wheel adjustable on one side of a gearwheel to be smoothed, and two further smoothing wheels, adjustable on the opposite side of the gearwheel. One of the smoothing wheels is a driven wheel. A clamping device is provided for axial clamping of the gearwheel to be smoothed, which is disposed so it may oscillate in the lengthwise direction perpendicular to its rotational motion.

A gearwheel burnishing and honing machine described in U.S. Pat. No. 4,414,780 to Jorgensen (corresponding German patent DE 32 30 860 C2) has three gearwheel-like processing elements for a gearwheel to be processed, which are driven to revolve during a lateral back and forth movement of a workpiece receiving device. The mode of operation of the novel device for smoothing gear wheels operates very similarly, but with no chip-removing processing being performed, but rather essentially cleaning of the tooth flanks, such as from impurities still adhering from the production process. The prior art device has a complicated construction and is maintenance-intensive and must be operated with a coolant and lubricant. Furthermore, adapting the construction to different sizes of workpieces, particularly the tracking of the oscillation axis, is very complex.

SUMMARY OF THE INVENTION

It is accordingly an object of the invention to provide a gear smoothing apparatus, which overcomes the above-mentioned disadvantages of the heretofore-known devices and methods of this general type and which device for smoothing gear wheels may be constructed simply and cost-effectively and is settable easily to different diameters of gear wheels to be smoothed and is easy to maintain.

With the foregoing and other objects in view there is provided, in accordance with the invention, a device for smoothing gear wheels, comprising:

a single smoothing wheel adjustable on one side of a gearwheel to be smoothed;

two further smoothing wheels adjustable on an opposite side of the gearwheel to be smoothed;

one of said smoothing wheels being a driven wheel;

a clamping device for axially clamping the gearwheel to be smoothed, said clamping device having a central axis and being disposed to be oscillatable in a direction perpendicular to a rotation of the gearwheel; and a clamping unit formed with bearing brackets supporting said single smoothing wheel and said further smoothing wheels, said bearing brackets being disposed to be tensioned against one another with the gearwheel to be smoothed centrally positioned therebetween and having a predetermined force applied thereto, said clamping unit being movably disposed for aligning an axis of rotation of the gearwheel to be smoothed with said central axis of said clamping device.

In other words, the objects of the invention are achieved in that a single smoothing wheel and the further smoothing wheels are mounted on bearing brackets which may be tensioned against one another in such a way that a gearwheel to be smoothed position between them is automatically centered and may have a previously determinable force applied to it, through which a clamping unit of the device is produced that clamps the gear wheels to be smoothed quasi-floating, since the entire clamping unit is implemented as movable in parallel, so that the axis of rotation of the gearwheel to be smoothed may be aligned coaxially to the central axis of an oscillating clamping device of the gearwheel to be smoothed easily, the clamping device and its oscillating drive being positioned fixed on the machine table.

This construction allows complete separation of the clamping of the gearwheel to be smoothed from the function of its coaxial alignment to the lengthwise direction of the oscillation axis of the clamping device and also from the technical embodiment of the clamping device itself and is therefore implemented simply and clearly and is thus producible very cost-effectively and is simple to maintain.

Other features which are considered as characteristic for the invention are set forth in the appended claims.

Because the bearing bracket for the single smoothing wheel is positioned on a first carriage and the bearing brackets for the two further smoothing wheels are positioned on a second carriage and both carriages may be tensioned against one another by the pressure cylinder via a connecting rod, a construction is achieved which is completely force-free to the outside, so that this entire clamping unit may be moved via a very small electromechanical, hydraulic, or dramatic drive, such as a positioning cylinder. The pressure cylinder may also optionally be implemented to operate using an electric motor, hydraulically, and/or pneumatically.

In accordance with an especially preferred embodiment of the invention, the first carriage is implemented as a frame and mounted on guide rails on a machine table and the second carriage is positioned inside the frame of the first carriage and is mounted on the same guide rails, the pressure cylinder being mounted on the frame of the first carriage and moving the second carriage inside the frame via a connecting rod, so that the smoothing wheel pair positioned on the second carriage may be moved in the direction toward the single smoothing wheel fixed on the first carriage while clamping the gearwheel to be smoothed.

The shared usage of the guide rails and the construction of the carriages are accordingly implemented very simply and are also very easy to maintain because of the viewability. Furthermore, a positioning cylinder, whose free end may engage either on the first carriage or on the second carriage, is coupled to the machine table so that the entire clamping unit may be positioned along the guide rails in the clamped state of a gearwheel to be smoothed in such a way that the axis of rotation of the gearwheel to be smoothed runs coaxially to a central axis of its clamping device.

It should be understood that, although the invention is illustrated and described herein as embodied in a device for smoothing gear wheels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
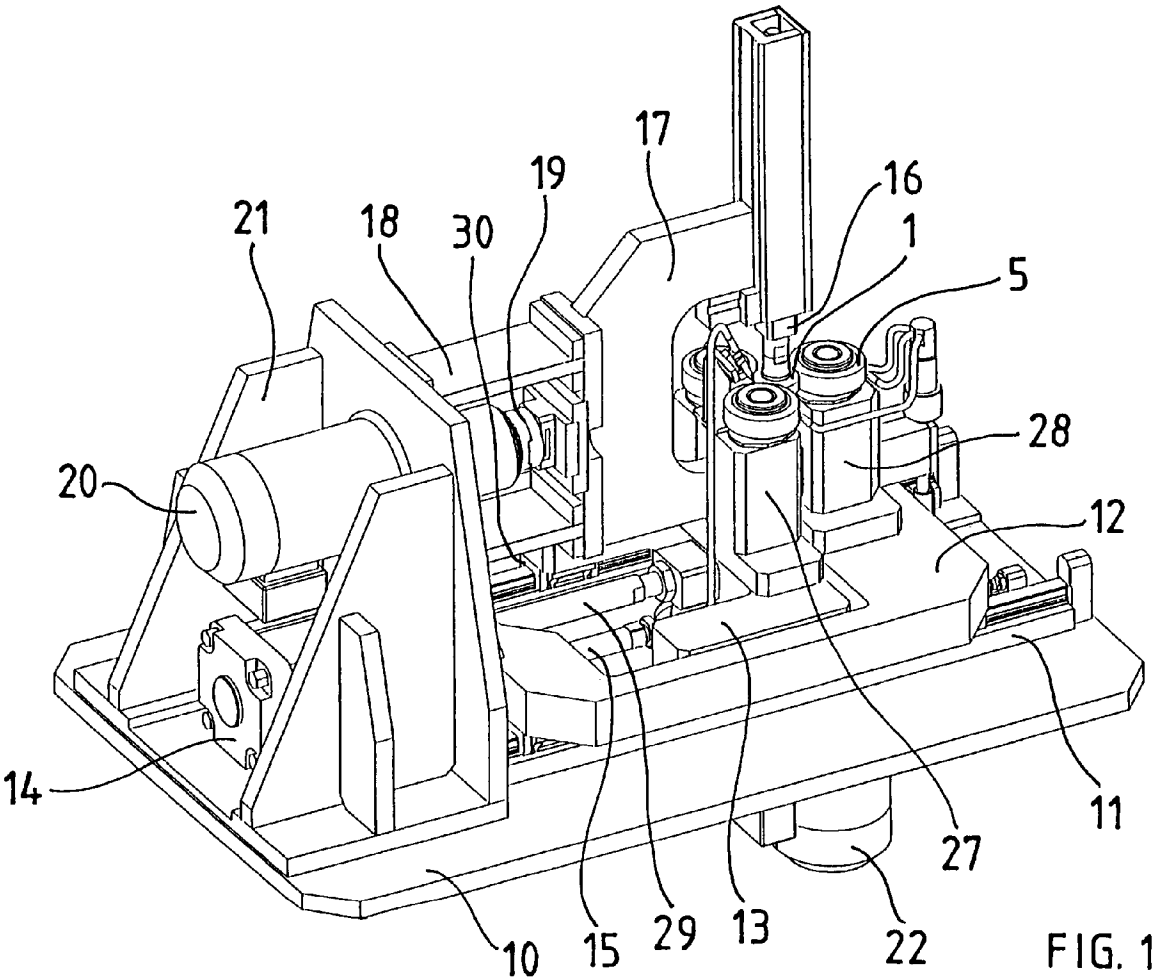
FIG. 1 is a perspective view of the device for smoothing gear wheels according to the invention.

Referring now to the figures of the drawing in detail and first, particularly, to FIG. 1 thereof, there is shown a novel apparatus for smoothing or burnishing gearwheels that includes a machine table 10, on which two parallel guide rails 11 are disposed. A frame-shaped carriage or slide 12 for a smoothing wheel 5, driven by a motor 22, is positioned so as to be movable along the rails 11, as well as a further carriage or slide 13, inside the carriage 12, for a driven pair of smoothing wheels 5. A pressure cylinder 14 is positioned on the carriage 12 for the driven smoothing wheel 5. The pressure cylinder 14 presses the carriage 13 for the driven pair of smoothing wheels 5 in the direction toward the driven smoothing wheel 5. A gearwheel 1 to be smoothed is held in operation clamped as a workpiece under a high radial pressure between the pair of smoothing wheels 5 and the single smoothing wheel 5. The gearwheel 1 to be smoothed is held axially clamped so it is radially movable by a clamping device 16, which is positioned on a C-shaped bracket 17, which is in turn attached via a spring assembly 18 and via an eccentric 19 on a holding stand 21 in such a way that it allows vertical oscillation of the gearwheel 1, which is only clamped axially, but is mounted quasi-floating radially, via an eccentric drive 20.

In order to be able to set the device for different sizes of gearwheels 1 to be smoothed and/or different smoothing wheels 5, the entire carriage 13 is movable together with the carriage 12 in relation to a fixed vertical axis of the clamping device 16 on the guide rails 11 via a small positioning cylinder 15.

Figure 2:
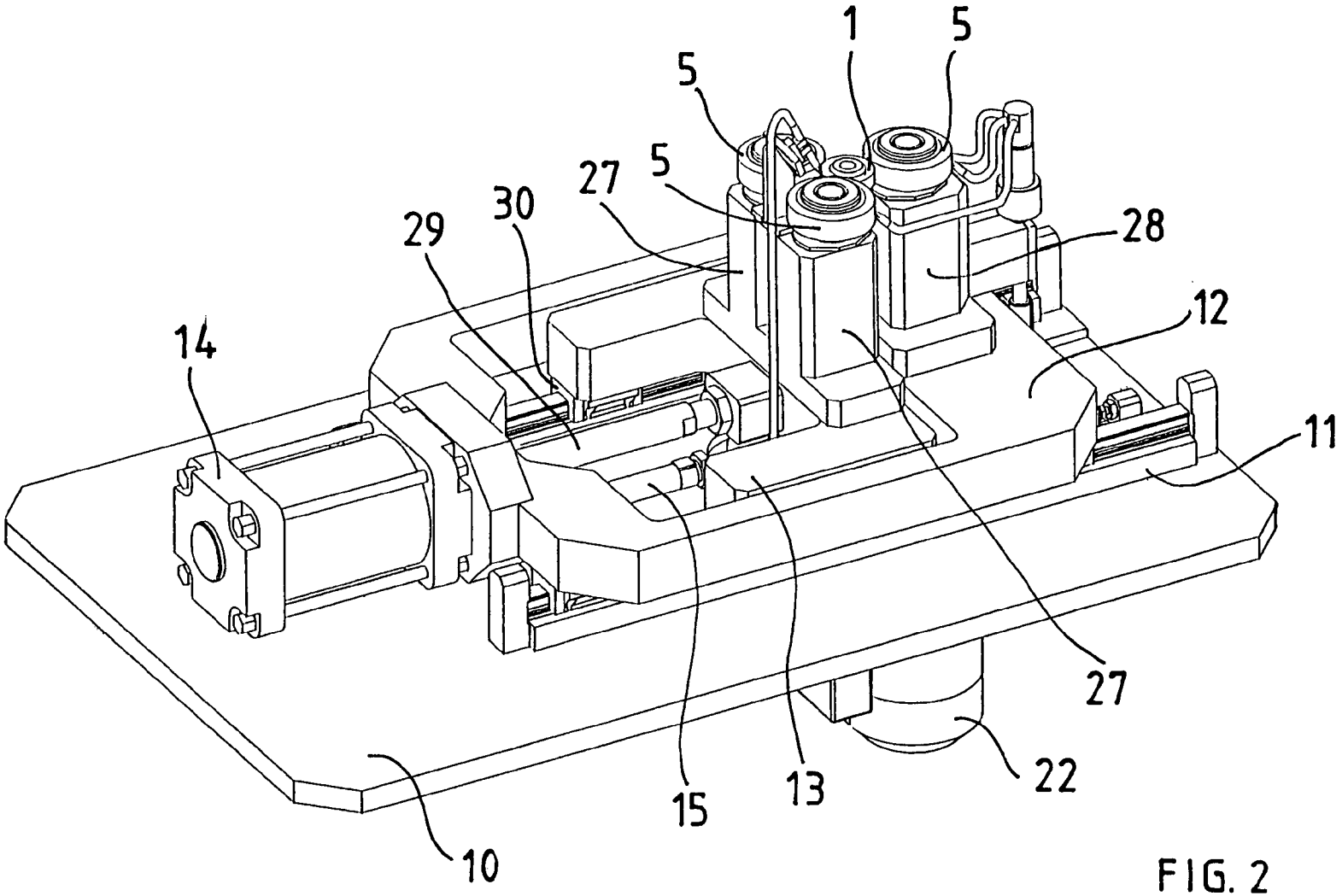
FIG. 2 is a slightly enlarged partial view of the clamping unit of the device.

As is particularly clear from FIG. 2, the second carriage 13 is implemented approximately U-shaped, the bearing brackets 27 for the pair of smoothing wheels 5 being positioned on the connecting leg and being positioned below the two side legs of the guides 30 for mounting the carriage 13 on the guide rails 11. Via the pressure cylinder 14, a pressure force of approximately 150 to 500 kg may be applied for floating clamping of the gearwheel 1 to be smoothed.

This application claims the priority, under 35 U.S.C. §119, of European patent application No. 04003106.4, filed Feb. 12, 2004; the entire disclosure of the prior application is herewith incorporated by reference. Additional and related information is also contained in my copending application No. 20/846,214, which is herewith incorporated by reference.

I claim:

1. A device for burnishing gear wheels, comprising:

a single burnishing wheel adjustable on one side of a gearwheel to be burnished;

two further burnishing wheels adjustable on an opposite side of the gearwheel to be burnished;

one of said burnishing wheels being a driven wheel;

a clamping device for axially clamping the gearwheel to be burnished, said clamping device having a central axis and being disposed to be oscillatable in a direction perpendicular to a rotation of the gearwheel;

a clamping unit formed with bearing brackets supporting said single burnishing wheel and said further burnishing wheels, said bearing brackets being disposed to be tensioned against one another with the gearwheel to be burnished centrally positioned therebetween and having a predetermined force applied thereto, said clamping unit being movably disposed for aligning an axis of rotation of the gearwheel to be burnished with said central axis of said clamping device; and a first slide supporting said bearing bracket with said single burnishing wheel and a second slide supporting said bearing brackets with said further burnishing wheels, and a connecting rod tensioning said first and second slides against one another.

2. The device according to claim 1, which comprises a pressure cylinder disposed to tension said bearing brackets on said first and second slides against one another.

3. The device according to claim 2, wherein said pressure cylinder is configured for at least one of a hydraulic and pneumatic actuation.

4. The device according to claim 1, wherein said first slide is a frame mounted on guide rails, said second slide is movably disposed inside said frame of said first slide and mounted on guide rails, and wherein said pressure cylinder is positioned on said first slide and said second slide and configured to generate a pressure force via a connecting rod of said pressure cylinder.

5. The device according to claim 1, wherein said first slide and said second slide are disposed for movement on common guide rails.

6. A device for burnishing gear wheels, comprising:

a single burnishing wheel adjustable on one side of a gearwheel to be burnished;

two further burnishing wheels adjustable on an opposite side of the gearwheel to be burnished;

one of said burnishing wheels being a driven wheel;

a clamping device for axially clamping the gearwheel to be burnished, said clamping device having a central axis and being disposed to be oscillatable in a direction perpendicular to a rotation of the gearwheel;

a clamping unit formed with bearing brackets supporting said single burnishing wheel and said further burnishing wheels, said bearing brackets being disposed to be tensioned against one another with the gearwheel to be burnished centrally positioned therebetween and having a predetermined force applied thereto, said clamping unit being movably disposed for aligning an axis of rotation of the gearwheel to be burnished with said central axis of said clamping device; and a positioning cylinder engaging said clamping unit and positioning an entire said clamping unit on guide rails, such that the axis of rotation of the gearwheel to be burnished is coaxially aligned with said central axis of said clamping device.

7. The device according to claim 6, wherein said positioning cylinder is one of a hydraulic cylinder and a pneumatic cylinder.

* * * * *